US010971823B1

(12) United States Patent
Sledkov

(10) Patent No.: US 10,971,823 B1
(45) Date of Patent: Apr. 6, 2021

(54) ARTIFICIAL DIELECTRIC MATERIAL AND FOCUSING LENSES MADE OF IT

(71) Applicant: VASANT LIMITED, Wellington (NZ)

(72) Inventor: Victor Aleksandrovich Sledkov, Wellington (NZ)

(73) Assignee: VASANT LIMITED, Wellington (NZ)

( * ) Notice: Subject to any disclaimer, the term of this patent is extended or adjusted under 35 U.S.C. 154(b) by 0 days.

(21) Appl. No.: 17/051,326

(22) PCT Filed: Apr. 24, 2020

(86) PCT No.: PCT/NZ2020/050037
§ 371 (c)(1),
(2) Date: Oct. 28, 2020

(87) PCT Pub. No.: WO2020/218927
PCT Pub. Date: Oct. 29, 2020

(30) Foreign Application Priority Data

Apr. 26, 2019 (NZ) ..... 752944

(51) Int. Cl.
*H01Q 15/08* (2006.01)
*H01Q 15/10* (2006.01)

(52) U.S. Cl.
CPC ..... *H01Q 15/08* (2013.01)

(58) Field of Classification Search
CPC ..... H01Q 1/38; H01Q 15/02; H01Q 15/08; H01Q 15/10; H01Q 15/14; H01Q 15/144
See application file for complete search history.

(56) References Cited

U.S. PATENT DOCUMENTS 2,577,619 A 12/1951 Kock
2,978,702 A * 4/1961 Pakan ..... H01Q 15/244 343/753
3,165,750 A 1/1965 Tell
3,254,345 A * 5/1966 Hannan ..... H01Q 15/10 343/911 R
3,430,248 A * 2/1969 Lightbowne ..... H01Q 15/10 343/911 R (Continued)

FOREIGN PATENT DOCUMENTS

NZ 752904 A1 11/2019

OTHER PUBLICATIONS

International Search Report and Written Opinion issued in PCT/NZ2020/050037 dated Aug. 3, 2020.

*Primary Examiner* — Tho G Phan
(74) *Attorney, Agent, or Firm* — Heslin Rothenberg Farley & Mesiti P.C.

(57) ABSTRACT

Provided herein are artificial dielectric materials comprising a plurality of sheets of a dielectric material and a plurality of short conductive tubes placed in the sheets of the dielectric material, wherein the sheets of the dielectric material containing the short conductive tubes are separated by sheets of the dielectric material without the short conductive tubes, and wherein axes of the tubes are orientated along at least two different directions. Also provided are methods for manufacture of such materials and cylindrical focusing lenses comprising such artificial dielectric materials. The artificial dielectric materials, lenses and their manufacture may provide desirable dielectric properties compared with known materials and manufacturing advantages.

24 Claims, 10 Drawing Sheets

(56) References Cited

U.S. PATENT DOCUMENTS

| | | | | |
|---|---|---|---|---|
| 3,886,558 | A * | 5/1975 | Cary | H01Q 15/10 343/708 |
| 3,886,561 | A * | 5/1975 | Beyer | H01Q 15/02 343/910 |
| 6,774,867 | B2 * | 8/2004 | Diaz | H01Q 7/00 343/700 MS |
| 8,803,738 | B2 * | 8/2014 | Nguyen | H01Q 15/08 343/700 MS |
| 2010/0283695 | A1 | 11/2010 | Geterud | |
| 2010/0295744 | A1 | 11/2010 | Lofbom et al. | |
| 2011/0003131 | A1 | 1/2011 | Matitsine | |

* cited by examiner

ARTIFICIAL DIELECTRIC MATERIAL AND FOCUSING LENSES MADE OF IT

CROSS-REFERENCE TO RELATED APPLICATIONS

The present invention application is a U.S. National Phase filing under 35 U.S.C. § 371 of International Application PCT/NZ2020/050037, filed Apr. 24, 2020, which claims priority from New Zealand patent application 752944, filed Apr. 26, 2019. The entire contents of each of these prior applications are hereby incorporated herein by reference.

FIELD OF THE INVENTION

The present invention relates to artificial dielectric materials and focusing lenses for electromagnetic waves.

OBJECTIVE OF THE INVENTION

The objective of the invention is to provide a light artificial dielectric material for manufacturing such devices as focusing lenses and antennas for radio communication. The provided material has to be simple for manufacturing and have repeatable properties.

BACKGROUND

Modern mobile communication market needs multi beam antennas creating narrow beams and operating in different frequency bands. Focusing dielectric lens is the main part of the most efficient multi beam antennas. Diameter of a focusing lens has to be several wave length of the electromagnetic wave spreading through a lens to create a narrow beam therefore some lenses of multi beam antennas for mobile communication have diameter more than 1 m. Such lenses made of usual dielectric materials are too heavy therefore much research was done to create lightweight and low loss lenses providing desirable properties of focusing lenses.

The most well-known lightweight artificial dielectric materials consist of randomly oriented conductive parts mixed with nonconductive parts made of lightweight dielectric material. It is very difficult to manufacture uniform material having desirable dielectric properties by randomly mixing of conductive and nonconductive parts therefore a focusing lens is the most expensive component of multi beam antennas. To improve properties and decrease cost of focusing lenses, development of such materials is constantly continuing.

U.S. Pat. No. 8,518,537 B2 describes the lightweight artificial dielectric material comprising plurality of randomly orientated small particles of lightweight dielectric material like polyethylene foam containing conductive fibers placed inside of each particle.

Patent application US 2018/0034160 A1 describes the lightweight artificial dielectric material comprising plurality of randomly orientated small multilayer particles of lightweight dielectric material containing thin conductive patches between layers. It is written in this application that such multilayer particles provide more dielectric permittivity than particles containing conductive fibers.

Patent application US 2018/0279202 A1 describes other kinds of the lightweight artificial dielectric material comprising a plurality of randomly orientated small particles.

One described material includes small multilayer particles of lightweight dielectric material containing thin conductive sheets between layers.

All lightweight artificial dielectric materials mentioned above are made by random mixing of small particles. Elimination of metal-to-metal contacts within the material that could lead to passive intermodulation distortion is needed, therefore manufacturing of such materials comprises many stages and its cost is high.

Randomly mixing provides isotropic properties of a final material consisting of small particles but some applications need dielectric material having anisotropic properties. For example cylindrical lens made of anisotropic dielectric material can reduce depolarization of electromagnetic wave passed through cylindrical lens and improve cross polarization ratio of multi beam antenna (U.S. Pat. No. 9,819,094 B2). The cylindrical lens made of isotropic artificial dielectric material creates depolarization of the electromagnetic wave passed through such lens therefore an antenna comprising such lens can suffer from high cross polarization level.

A lightweight artificial dielectric material providing anisotropic properties and suitable for manufacturing a cylindrical lens was described by the New Zealand patent application 752904, filed Apr. 25, 2019. This material consists of short conductive tubes having thin walls and placed inside of a lightweight dielectric material. Tubes are placed in layers. One layer comprises a sheet of a lightweight dielectric material containing plurality of holes. A lightweight dielectric material can be a foam polymer. Tubes are placed in holes made in a sheet of a lightweight dielectric material and contain air inside. Layers containing tubes are separated by layers of a lightweight dielectric material without tubes. The axes of all conductive tubes are directed in perpendicular from layers.

Such structure could have dielectric permittivity (Dk) up to 2.5 for an electromagnetic wave spreading along of axes of tubes but its Dk is significantly smaller for an electromagnetic wave spreading in a perpendicular direction. The reason of such unwanted property of the known artificial dielectric material is anisotropic property of the tubes.

An electromagnetic wave propagating through artificial dielectric material comprising conductive particles excites circular currents flowing on the conductive particles therefore permeability of such materials is less than 1. This effect was described many years ago (W. E. Kock Metallic delay lenses. //Bell System Technical Journal, v.27, pp. 58-82, January 1948). When an electromagnetic wave propagates through square or hexagonal lattice of conductive tubes in direction along the axes of the tubes delay coefficient (n) does not depend from polarization since any polarization excites the same circular currents. When electromagnetic wave propagates through square or hexagonal lattice of conductive tubes in direction perpendicular the axes of the tubes n depends from polarization. The biggest circular currents flow on a wall of the conductive tube in direction perpendicular to axis of the conductive tube when magnetic field of electromagnetic wave is directed in parallel to the axis of the conductive tube. As a result permeability for such polarization is significantly less than for other polarizations and delay coefficient n is also less than n for other polarizations. It is possible to increase delay coefficient n for such polarization by decreasing distance between the tubes disposed in a layer. Increasing capacity between the tubes disposed in the layer increases permittivity of the artificial dielectric material. As a result the known artificial dielectric material can provide very small difference between n for any polarization of electromagnetic wave spreading in direction perpendicular to axes of the conductive tubes but can't provide the same n for other directions of electromagnetic wave.

Because n depends on angle between direction of electromagnetic wave crossing the material and axes of tubes, such artificial dielectric material doesn't suit for many applications requiring an isotropic dielectric material providing the same value of n for any direction and polarization of electromagnetic wave. For example spherical Luneburg lenses have to be made of isotropic dielectric material having the same n for any direction and polarization of electromagnetic wave to keep polarization of electromagnetic wave passed through spherical lens. Therefore a need exists to create an artificial dielectric material providing less dependence n from direction and polarization of electromagnetic wave crossing the material in comparison with the prior art, for example as described by the NZ752904. Such artificial dielectric material has to provide as desirable anisotropic properties to reduce depolarization of electromagnetic wave passed through cylindrical lens so as isotropic properties to be suitable for manufacturing spherical Luneburg lenses. At the same time manufacturing of such material has to be simpler than manufacturing of known lightweight artificial materials made by randomly mixing of small particles containing conductive elements isolated by from each other.

SUMMARY OF INVENTION

The present invention provides an artificial dielectric material comprising a plurality of sheets of a dielectric material and a plurality of short conductive tubes placed in the sheets of the dielectric material, wherein the sheets of the dielectric material containing the short conductive tubes are separated by sheets of the dielectric material without the short conductive tubes, and wherein axes of the tubes are orientated along at least two different directions.

Preferably, the at least two different directions are orthogonal directions. The short conductive tubes may have a cross section in a shape of a circle or a polygon, and are preferably made of aluminium. However, tubes may alternatively be made from copper, nickel, silver or gold.

Preferably the dielectric material is a foam polymer, which is made of a material selected from polyethylene, polystyrene, polypropylene, polyurethane, silicon and polytetrafluoroethylene.

The short conductive tubes placed in one layer may form a square structure (lattice) providing equal distances between neighboring tubes disposed at the same row or at the same column. Alternatively, the short conductive tubes placed in one layer form a honeycomb structure (lattice) providing equal distances between any neighboring tubes.

The axes of the short conductive tubes placed in one layer may be directed in the same direction. Such axes in one layer may be directed perpendicular to the layer, or may be directed parallel to the layer.

The axes of some short conductive tubes placed in one layer may be directed perpendicular to the layer and axes of other short conductive tubes may be directed in parallel to the layer. The axes of the short conductive tubes directed in parallel to the layer may be directed in different directions.

Delay coefficient n of the provided artificial dielectric material depends of orientation of the tubes, distances between the tubes and between the layers, therefore the provided artificial dielectric material comprising the tubes having different orientation of axes in a layer, and layers with different structures provides more chances to reach desirable dielectric properties compared with the known material such as is described by the NZ patent application 752904. For example dependence n of electromagnetic wave spreading direction and polarization is less since the axes of tubes have multiple directions, such as three orthogonal directions. As a result the provided artificial dielectric material can be applied for manufacturing of many kinds of focusing lenses and antennas.

By providing the above artificial dielectric material the invention goes at least some way to overcoming deficiencies of the known lightweight artificial dielectric material described by the NZ patent application 752904 and provides a light artificial dielectric material providing less dependence n from direction and polarization of electromagnetic wave spreading through the material. At the same time manufacturing of such material may be simpler than manufacturing of known analogues made by mixing of small particles containing conductive elements isolated by from each other.

Instead, the present invention provides a method for manufacturing an artificial dielectric material comprising placing thin conductive tubes in a plurality of sheets of a dielectric material, and stacking said sheets together, wherein the sheets of the dielectric material containing the short conductive tubes are separated by sheets of the dielectric material without the short conductive tubes, and wherein axes of the tubes are orientated along at least two different directions. Preferably, the short conductive tubes are placed into pre-existing holes in the sheets of the dielectric material.

The invention also provides a cylindrical focusing lens comprising the artificial dielectric material described above.

The cylindrical focusing lens may comprise a wide range of structures dependent on the nature of the artificial dielectric material used and its structure. For example, the tubes of each layer may form a square or hexagonal lattice. (FIG. 2). The tubes of each layer may be placed radially in circles and form a 'sunflower structure'. (FIGS. 3-8). The layers may have tubes having axes directed only perpendicular to the layer and layers containing the tubes having axes directed only in parallel to the layer. (FIGS. 2, 5*a*). The axes of the tubes of one layer containing the tubes with axes directed only in parallel to the layer may be directed in perpendicular to axes of the tubes of other layer containing the tubes with axes directed in parallel to the layer. (FIGS. 2*b*, 2*c*). Each layer may contain tubes with axes directed perpendicular to the layer and tubes with axes directed in parallel to the layer. (FIGS. 4, 6, 7, 8). The axes of the tubes directed in parallel to the layer and displaced at even layers may be directed perpendicular to axes of the tubes directed in parallel to the layer and displaced at odd layers. (FIG. 6). Each layer may contain circles of the tubes having the axes directed perpendicular to the layer and circles of the tubes having the axes directed in parallel to the layer. (FIG. 8). In such case at least one circle may contain tubes having the axes directed in parallel to the layer and in parallel to the circle. (FIG. 8). At least one circle may contain tubes having the axes directed in parallel to the layer and perpendicular to the circle. (FIG. 8).

The cylindrical focusing lens may include a dielectric rode placed along longitudinal axis of the cylindrical focusing lens. (FIG. 7).

The cylindrical focusing lens is provided for use with multi beam antennas and is simpler for manufacturing compared with known analogues.

DESCRIPTION OF THE DRAWINGS

In further describing the invention, reference is made to the accompanying drawings by way of example only in which.

Figure 2A:
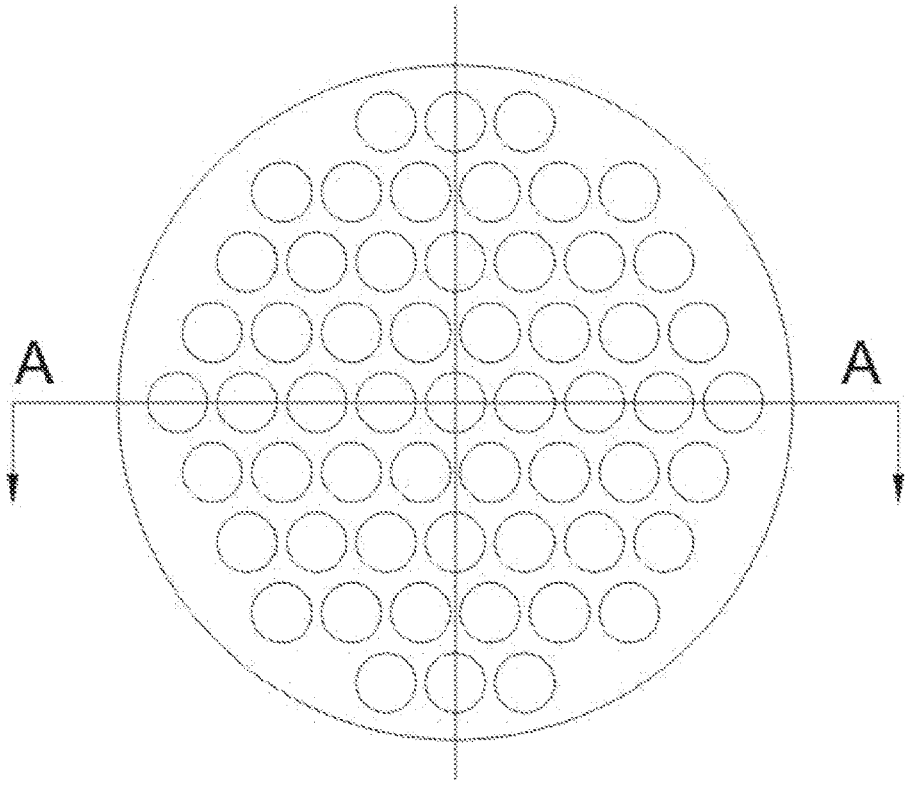
FIGS. 2*a*-2*c* show top views of layers which are combined to form a cylindrical lens, the cross section of which is shown in FIG. 2*d;*

Throughout FIGS. 2*a*-8*b*, sectional lines A-A are used to indicate sections in corresponding drawings of the same set. For example, the sections indicated in FIGS. 2*a*-2*c* are represented in the composite view of the layers represented by FIGS. 2*a*-2*c* shown in FIG. 2*d*.

DETAILED DESCRIPTION OF THE INVENTION

As described and shown in the figures the lightweight artificial dielectric material includes a plurality of short conductive tubes having thin walls and placed inside of a lightweight dielectric material. A cross section of the tube could be a circle or a polygon for example square, hexagon or octagon. The short conductive tubes are placed in layers. One layer comprises a sheet of the lightweight dielectric material which may contain a plurality of holes for inserting the tubes. The lightweight dielectric material can be a foam polymer. The tubes are placed in holes made in a sheet of a lightweight dielectric material and contain air inside of tubes. The layers containing tubes are separated by layers of a lightweight dielectric material without tubes. The separating layers also could contain holes having smaller diameter than diameter of holes for tubes to provide air ventilation through the lightweight dielectric material. The tubes placed in neighboring layers could be placed above each other on the same axes or layers could be shifted from each other and tubes could have different axes.

The tubes are disposed with different orientation of tubes' axes. Axes of some tubes are directed perpendicular to the layers and axes of other tubes are directed in parallel to the layers. The tubes having axes directed in parallel to the layers could be disposed in perpendicular to each other. Thus, because the axes of the tubes have three orthogonal directions as a result dielectric properties of the provided lightweight artificial dielectric material are less dependent from direction and polarization of electromagnetic wave crossing the material. The tubes placed in one layer could have the same orientation of axes or different orientation. Placed above each other layers containing tubes could have the same structure or different structures.

With reference to FIGS. 1*a*-1*h*, several embodiments of the present invention are shown where round tubes placed in one layer may form different structures and orientations.

Figure 1A:
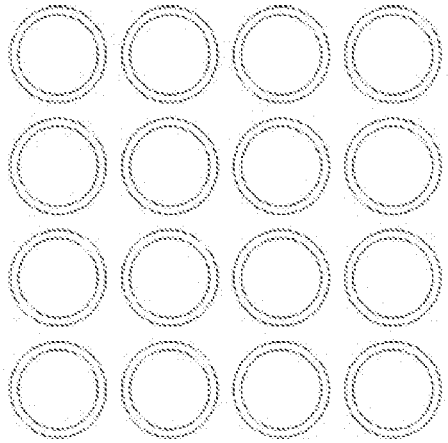
FIGS. 1*a*-1*h* show top views of layers of dielectric material and comprising tubes in various orientations according to various embodiments of the invention.
Figure 1B:
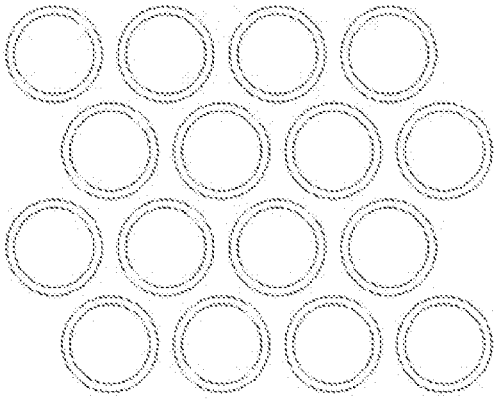
Figure 1C:
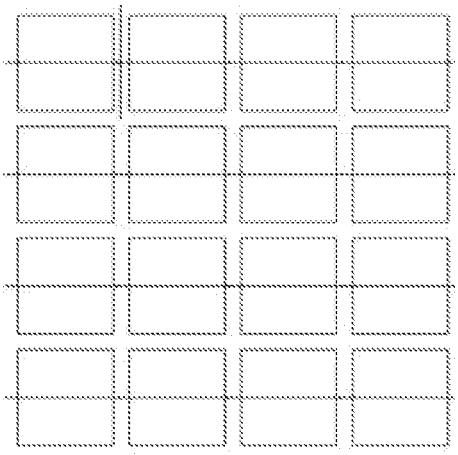
Figure 1D:
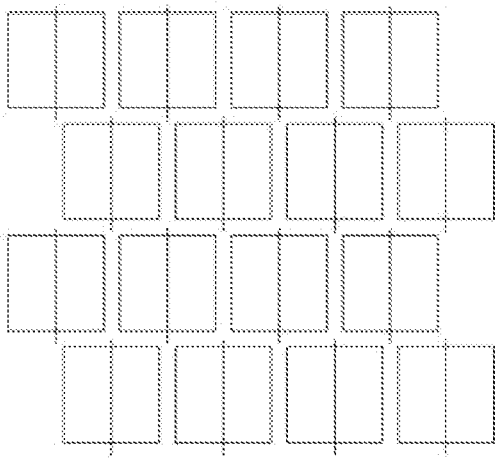
Figure 1E:
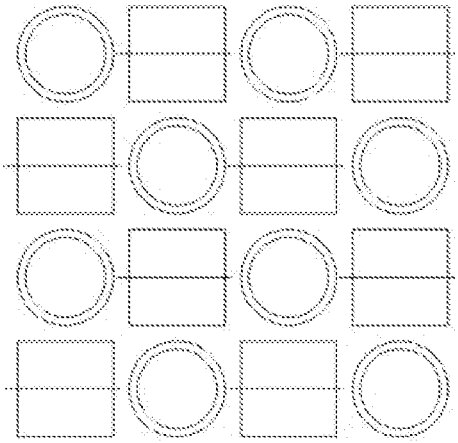
Figure 1F:
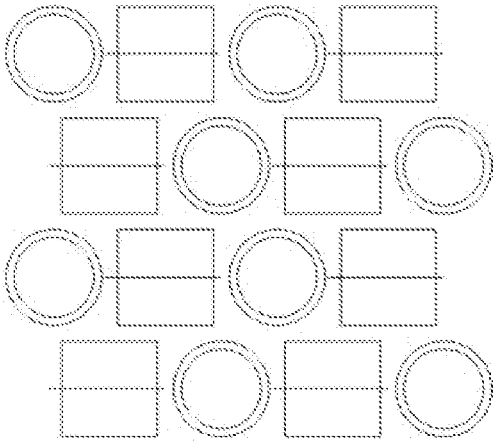

FIG. 1*a* shows the top view of a layer containing round tubes placed in rows where axes of tubes are perpendicular to the layer and distances between tubes of neighboring rows and distances between neighboring tubes of one row are equal. FIG. 1*b* shows the top view of a layer containing round tubes placed in rows where axes of tubes are perpendicular to the layer. Rows are shifted on half of a distance between neighboring tubes placed in one row and distances between any neighboring tubes are equal. FIG. 1*c* shows the top view of a layer containing round tubes placed in rows where axes of all tubes are in parallel to the layer and in parallel to each other. FIG. 1*d* shows the top view of a layer containing round tubes placed in rows where axes of tubes are in parallel to layer and in parallel to each other. Rows are shifted on half of a distance between neighboring tubes placed in one row. FIG. 1*e* shows the top view of a layer containing round tubes placed in rows where axes of one half of the tubes are directed perpendicular to the layer and axes of other half of the tubes are directed in parallel to the layer. Each row contains tubes with axes directed perpendicular to the layer and tubes with axes directed in parallel to the layer. FIG. 1*f* shows the top view of a layer containing round tubes placed in rows where axes of one half of the tubes are directed perpendicular to the layer and axes of the other half of the tubes are directed in parallel to the layer. Each row contains tubes with axes directed perpendicular to the layer and tubes with axes directed in parallel to the layer. The neighboring rows are shifted on half of a distance between neighboring rows.

Figure 1G:
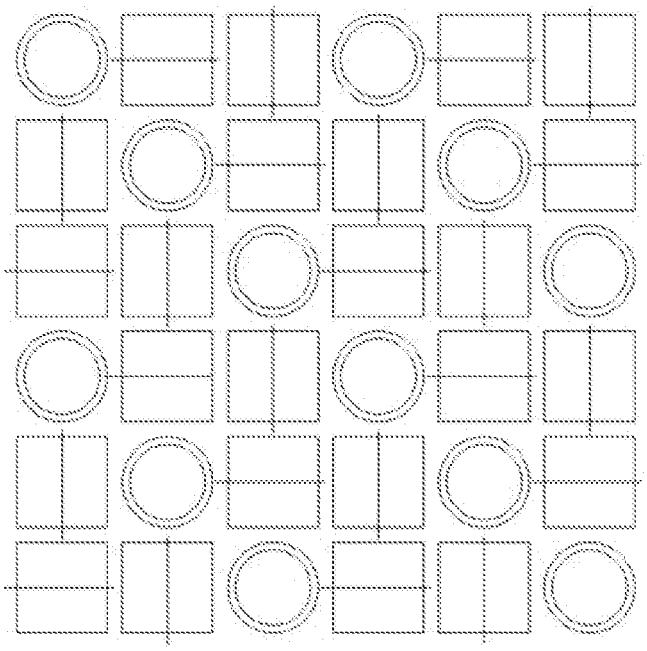
Figure 1H:
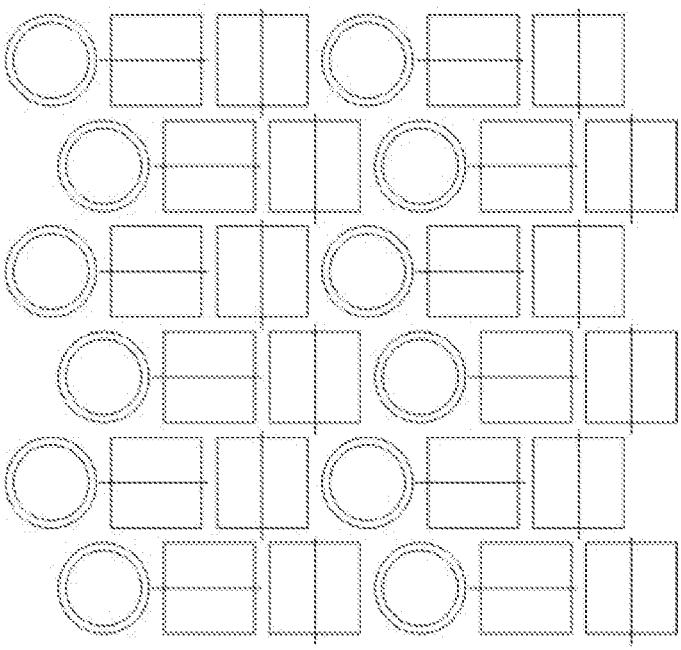

FIG. 1*g* shows the top view of a layer containing round tubes placed in rows where axes of one third of the tubes are directed perpendicular to the layer and axes of other tubes are directed in parallel to the layer. Axes of one half of the parallel tubes are directed perpendicular to axes of the other half of the parallel tubes. FIG. 1*h* shows the top view of a layer containing round tubes placed in rows where axes of one third of the tubes are directed perpendicular to the layer and axes of other tubes are directed in parallel to the layer. Axes of one half of the parallel tubes are directed perpendicular to axes of the other half of the parallel tubes. The neighboring rows are shifted on half of a distance between of neighboring rows. The tubes shown at FIGS. 1*a*-1*h* have a cross section of a round shape but it is possible to use tubes having any other cross section, for example a shape of any polygon.

Figure 2B:
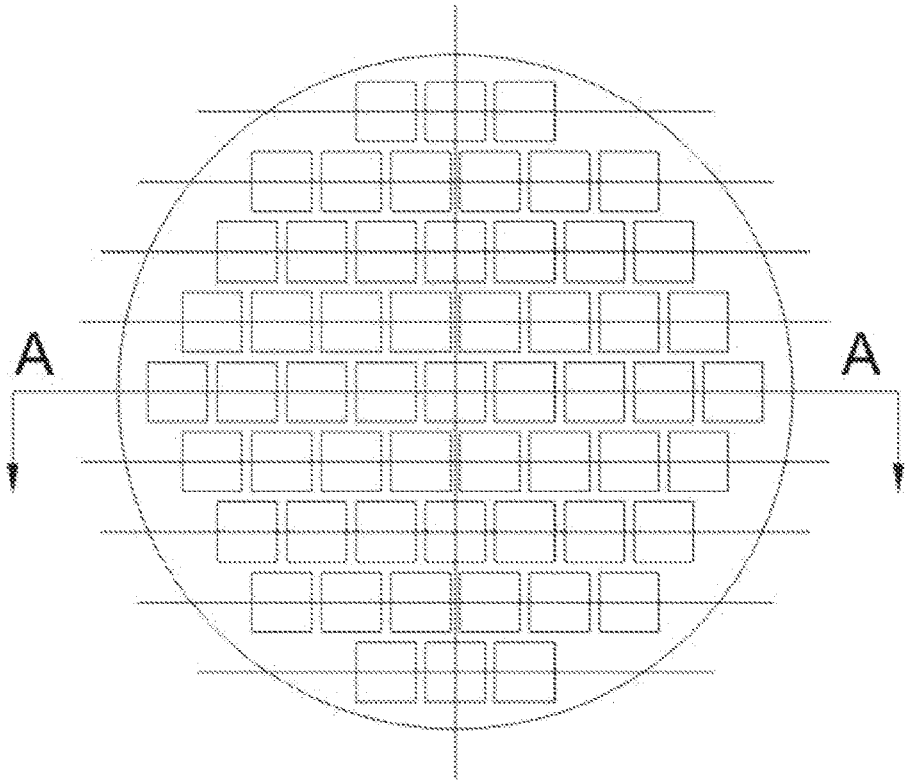

The drawings also provide several exemplary embodiments of a cylindrical lens made of the provided artificial dielectric material and the manner in which the layers may be arranged. With reference to FIG. 2*a*, this shows the top view of the first layer of a cylindrical lens where tubes are placed in rows and axes of the tubes are directed perpendicular to the layer. Distances between neighboring tubes are equal. FIG. 2*b* shows the top view of the second layer of a cylindrical lens where tubes are placed in rows and axes of the tubes are directed in parallel to the layer and along of rows. Distances between neighboring tubes are equal. FIG.

Figure 2C:
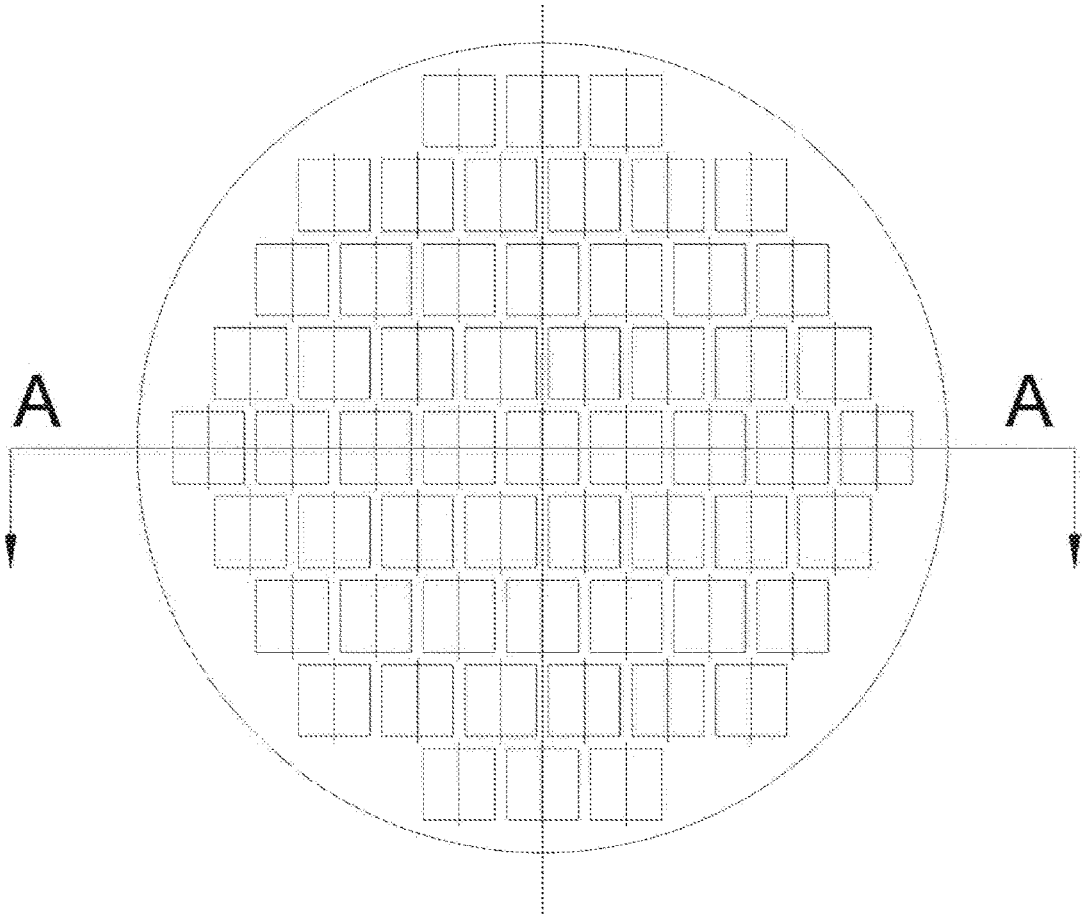
Figure 2D:
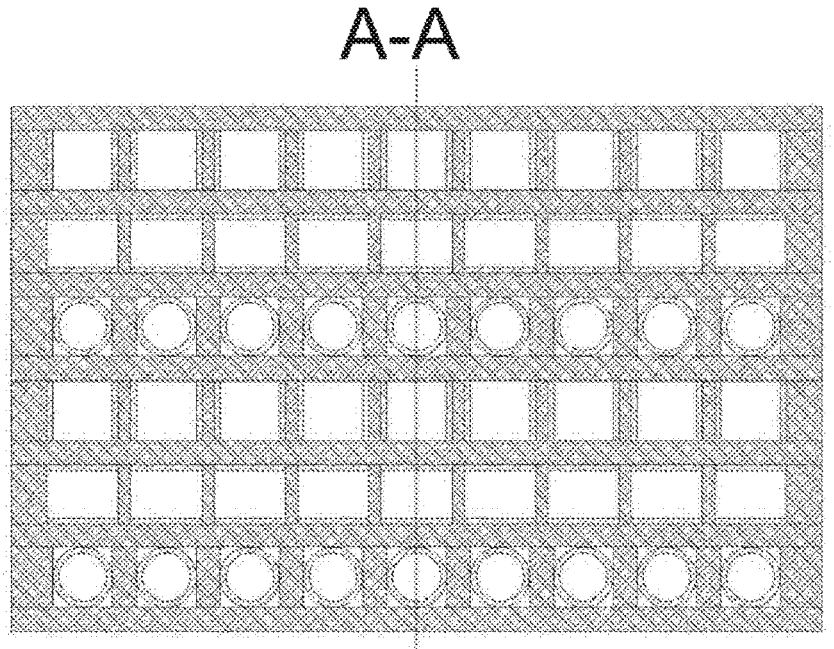

2*c* shows the top view of the third layer of a cylindrical lens where tubes are placed in rows and axes of the tubes are directed in parallel to the layer and perpendicular to rows. Distances between neighboring tubes are equal. FIG. 2*d* shows the cross section of a cylindrical lens comprising six layers of the tubes. The first layer and the fourth layer are equal. The second layer and the fifth layers are equal. The third layer and the sixth layer are equal. Thus such lens is assembled of three kinds of different layers.

Figure 3A:
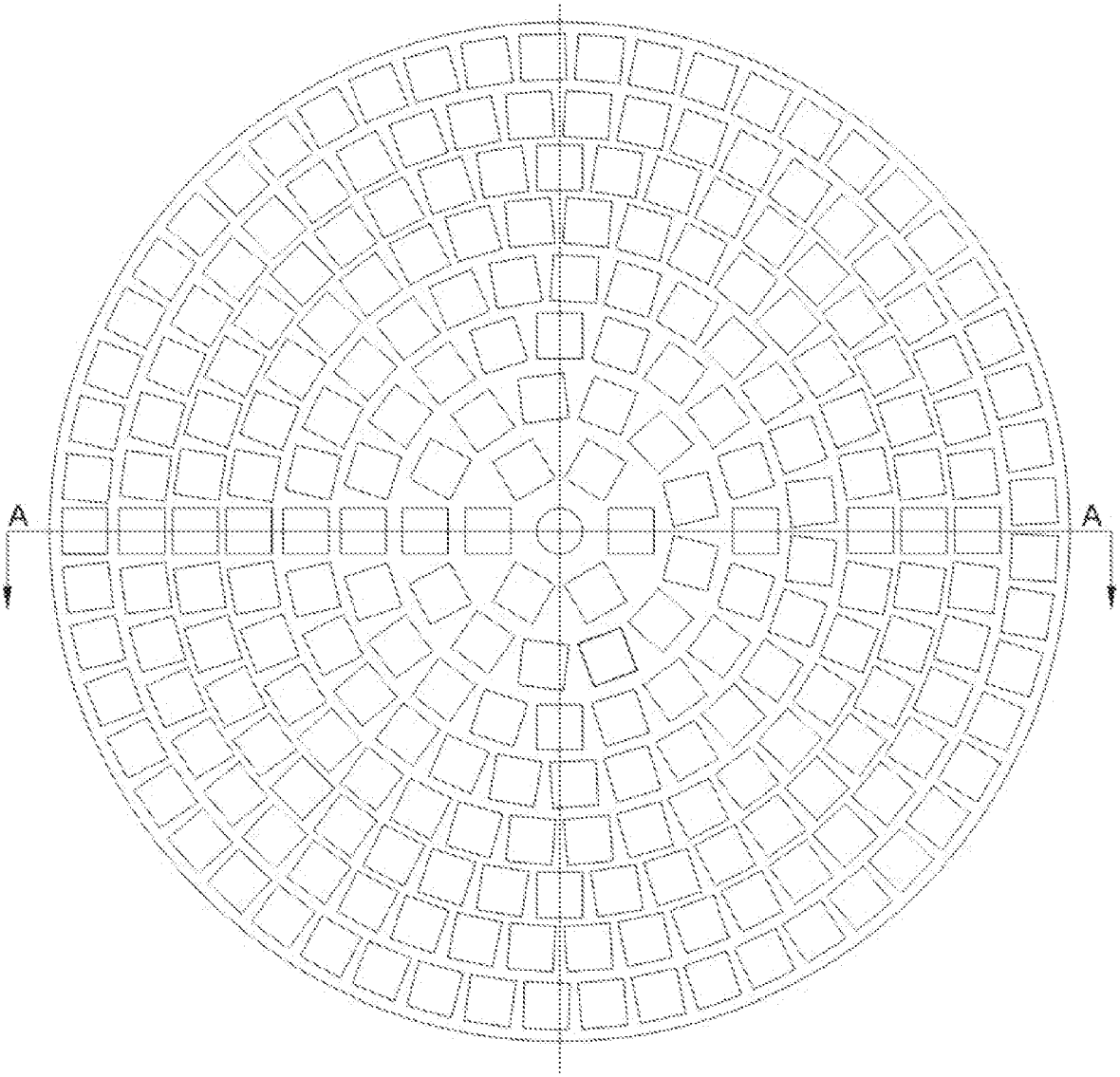
FIGS. 3*a* and 3*b* show a top view and cross-section view, respectively, of a cylindrical lens assembled of two kinds of different layers.
Figure 3B:
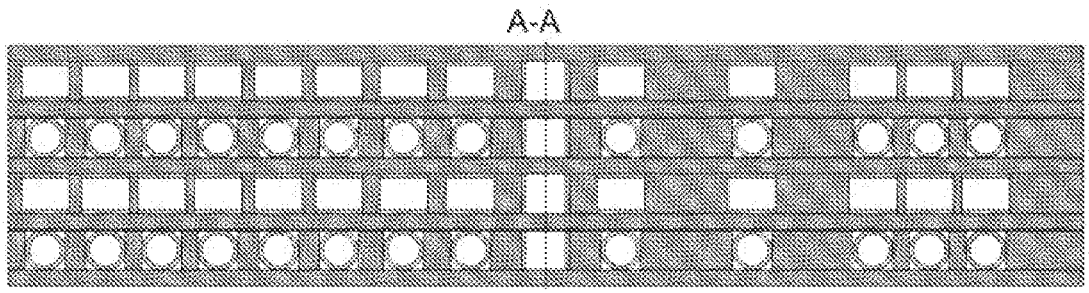

For other applications the tubes displaced in a layer could form other structures and lenses could comprise other quantities of different layers. For example, a cylindrical lens assembled of two kinds of different layers is shown in FIGS. 3*a* and 3*b*. FIG. 3*a* shows the top view of the first layer of a cylindrical lens where tubes are placed in circles and the axis of one tube placed in the center of the lens is directed perpendicular to the layer. Axes of other tubes are directed in parallel to the layer and perpendicular to the circles. The tubes forming the second layer are placed opposite of tubes forming the first layer but its axes are directed in parallel to circles excluding one tube placed in a center of the lens. FIG. 3*b* shows the cross section of a cylindrical lens comprising four layers of the tubes. The first layer and the third layer are equal. The second layer and the fourth layer are equal. Thus such lens is assembled of two kinds of different layers.

Figure 4A:
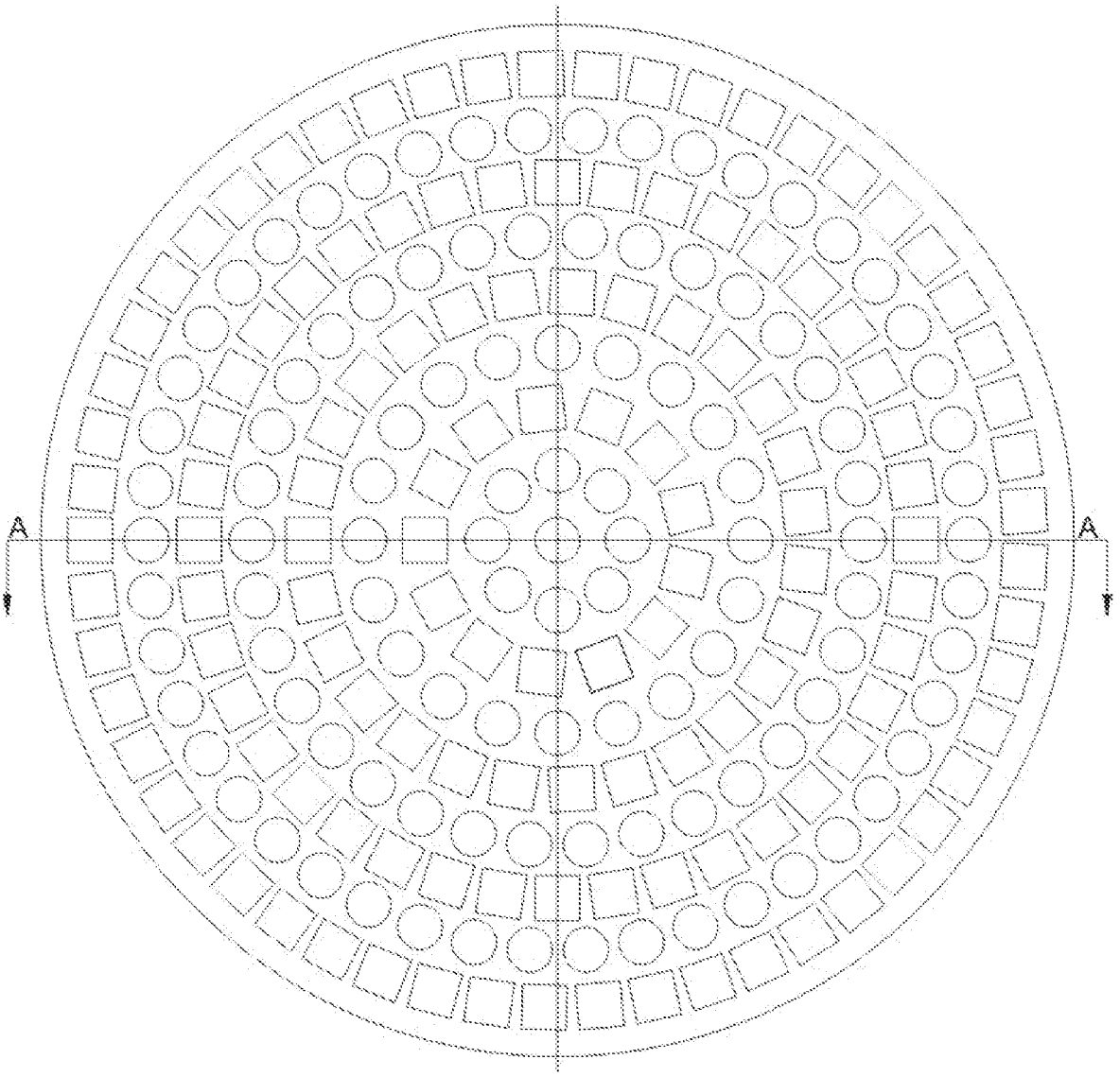
FIGS. 4*a* and 4*b* show a top view and a cross-section view, respectively, of a cylindrical lens comprising a plurality of short tubes placed in circles and having two orthogonal orientations of its axes.
Figure 4B:
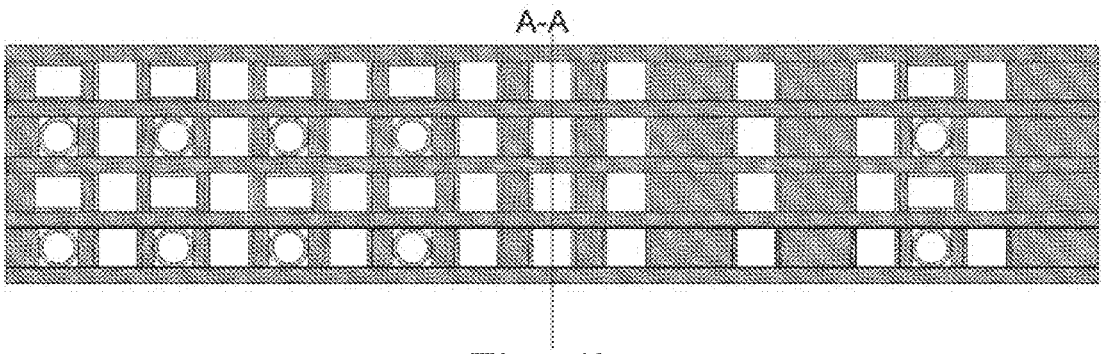

Another embodiment of the present invention is shown in FIGS. 4*a* and 4*b* where each layer of a cylindrical lens comprises a plurality of short tubes placed in circles and having two orthogonal orientations of its axes. FIG. 4*a* shows the top view of a layer. Axes of tubes placed on the first circle from outer contour of a lens are directed along a layer. Axes of tubes placed on the second circle from outer contour of a lens are directed perpendicular to a layer. FIG. 4*b* shows the cross section of a cylindrical lens comprising four layers of the short tubes. The first layer and the second layer have different orientation of tubes placed on odd circles. Axes of tubes of the first layer placed on odd circles are directed perpendicular to circles. Axes of tubes of the second layer placed on odd circles are directed in parallel to circles. The first layer and the third layer are equal. The second layer and the fourth layers are equal. Thus such lens is assembled of two kinds of different layers.

Figure 5A:
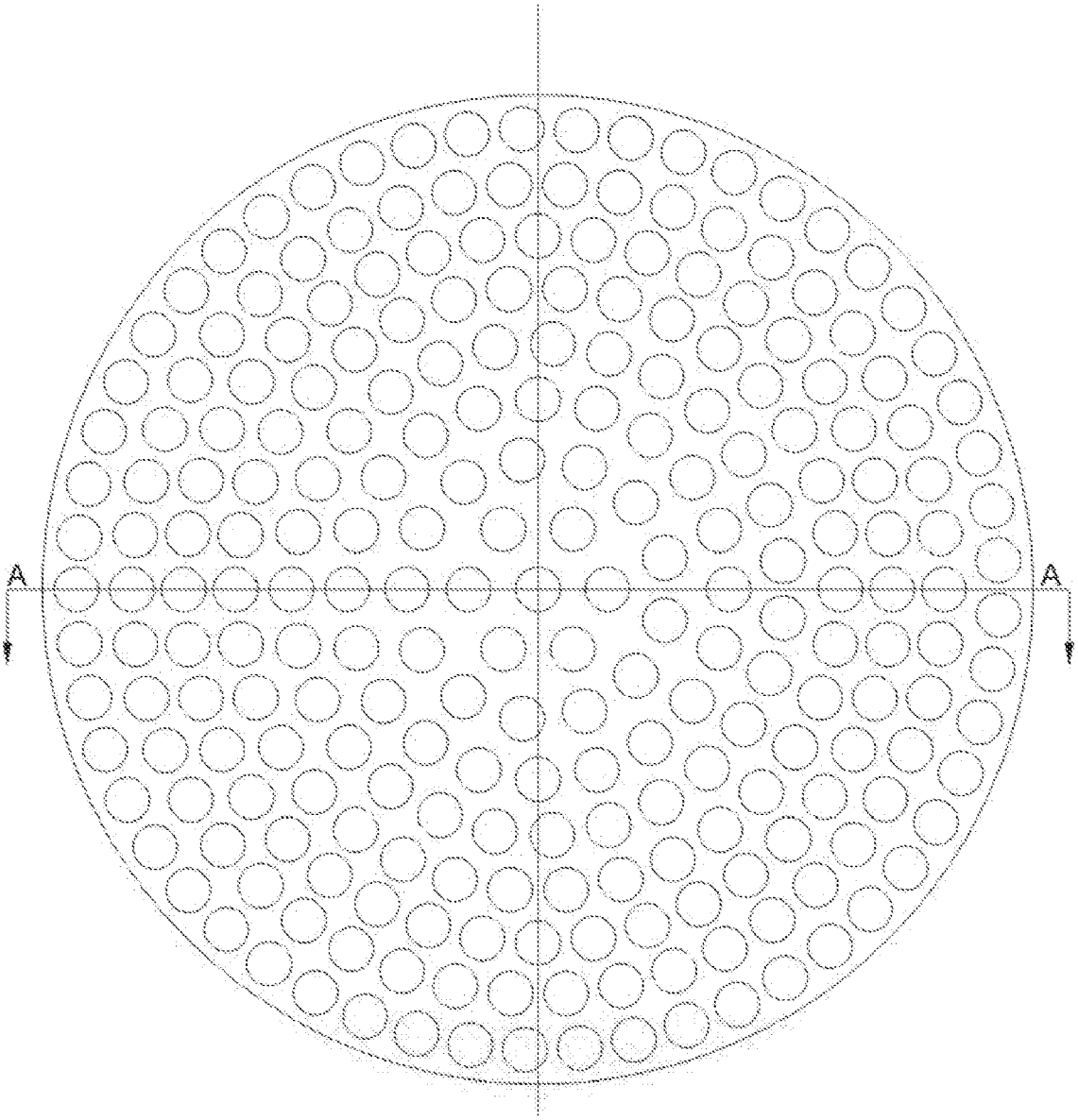
FIGS. 5*a* and 5*b* show a top view and a cross-section view, respectively, of a cylindrical lens comprising a plurality of short tubes placed in circles.
Figure 5B:
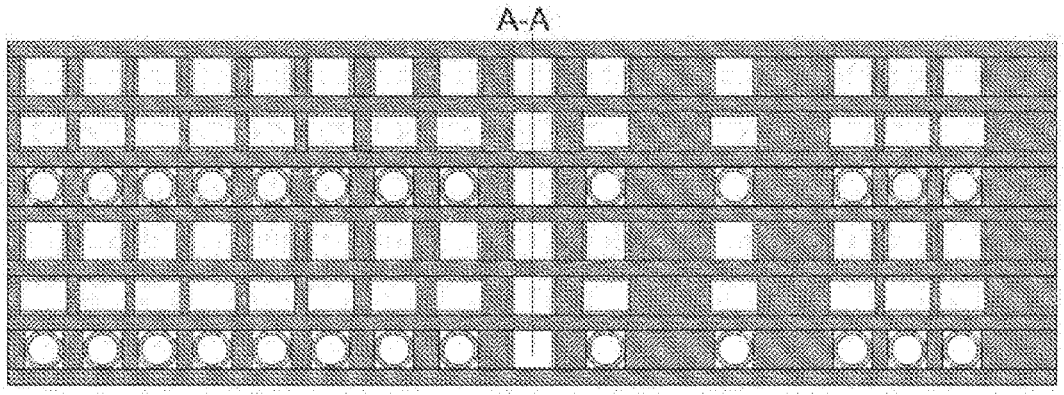

Another embodiment of the present invention is shown in FIGS. 5*a* and 5*b* where each layer of a cylindrical lens comprises a plurality of short tubes placed in circles. FIG. 5*a* shows the top view of the first layer of a cylindrical lens where tubes are placed in circles and its axes are directed perpendicular to the layer. FIG. 5*b* shows the cross section of a cylindrical lens comprising six layers of the tubes. The first layer and the fourth layer are equal. The second layer and the fifth layers are equal. The third layer and the sixth layer are equal. Thus such lens is assembled of three kinds of different layers. Top views of the second layer and the third layer are shown in FIG. 3*a*.

Figure 6A:
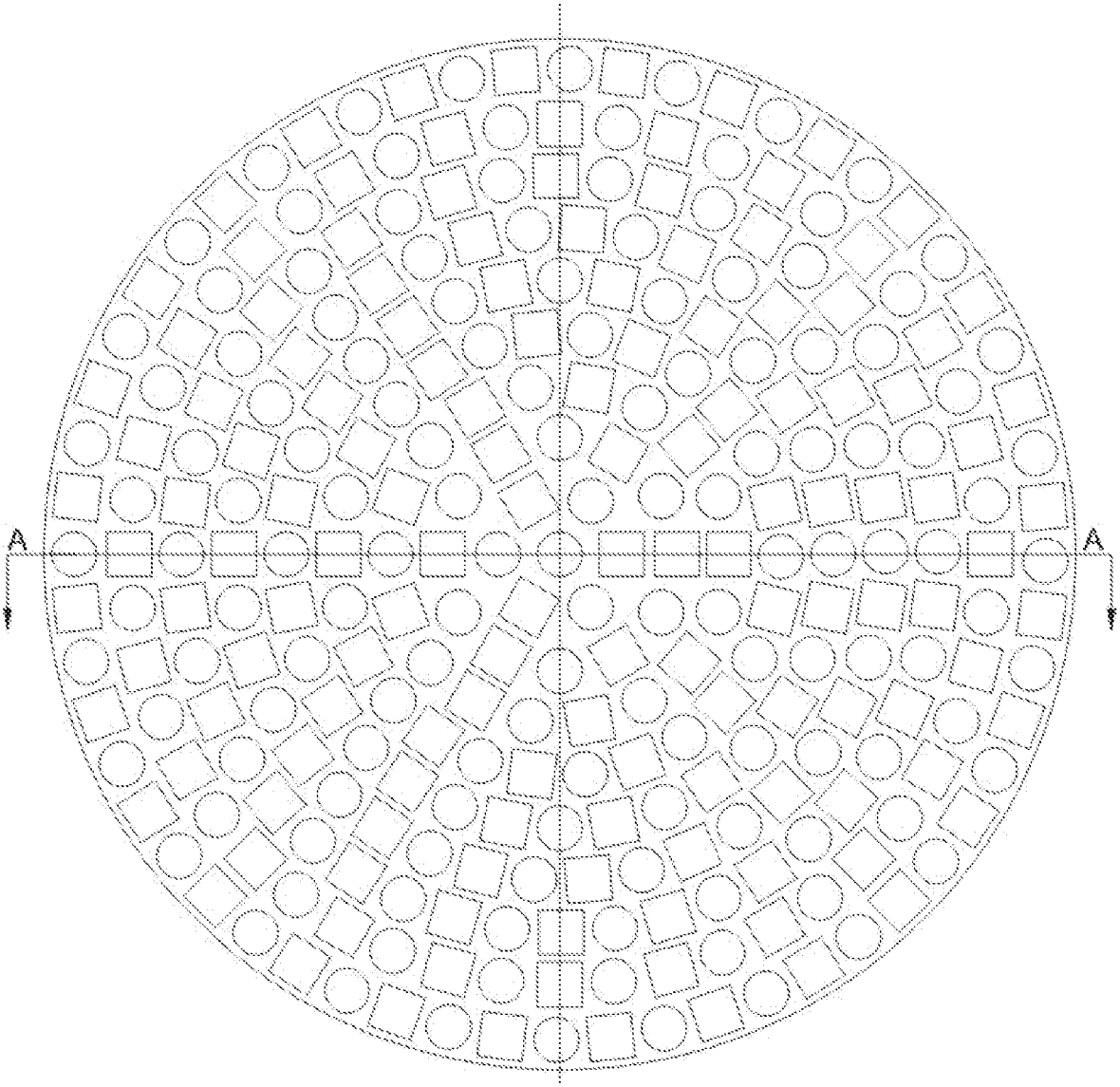
FIGS. 6*a* and 6*b* show a top view and a cross-section view, respectively, of a cylindrical lens comprising a plurality of short tubes placed in circles and having two orthogonal orientations of its axes.
Figure 6B:
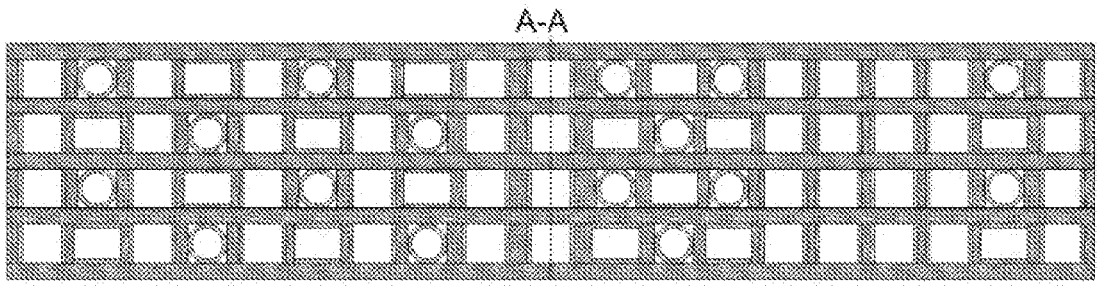

Another embodiment of the present invention is shown in in FIGS. 6*a* and 6*b* where each layer of a cylindrical lens comprises a plurality of short tubes placed in circles and having two orthogonal orientations of its axes. FIG. 6*a* shows the top view of the first layer of a cylindrical lens where tubes form structure shown in FIGS. 1*e* and 1*f*. The tubes are placed in circles and each circle contains tubes with axes directed perpendicular to layer and tubes with axes directed in parallel to layer. FIG. 6*b* shows the cross section of a cylindrical lens comprising four layers of the tubes. Tubes of the first layer with axes directed in parallel to the layer are directed along circles. Tubes of the second layer with axes directed in parallel to the layer are directed perpendicular to circles. The first layer and the third layer are equal. The second layer and the fourth layers are equal. Thus such lens is assembled of two kinds of different layers.

Figure 7A:
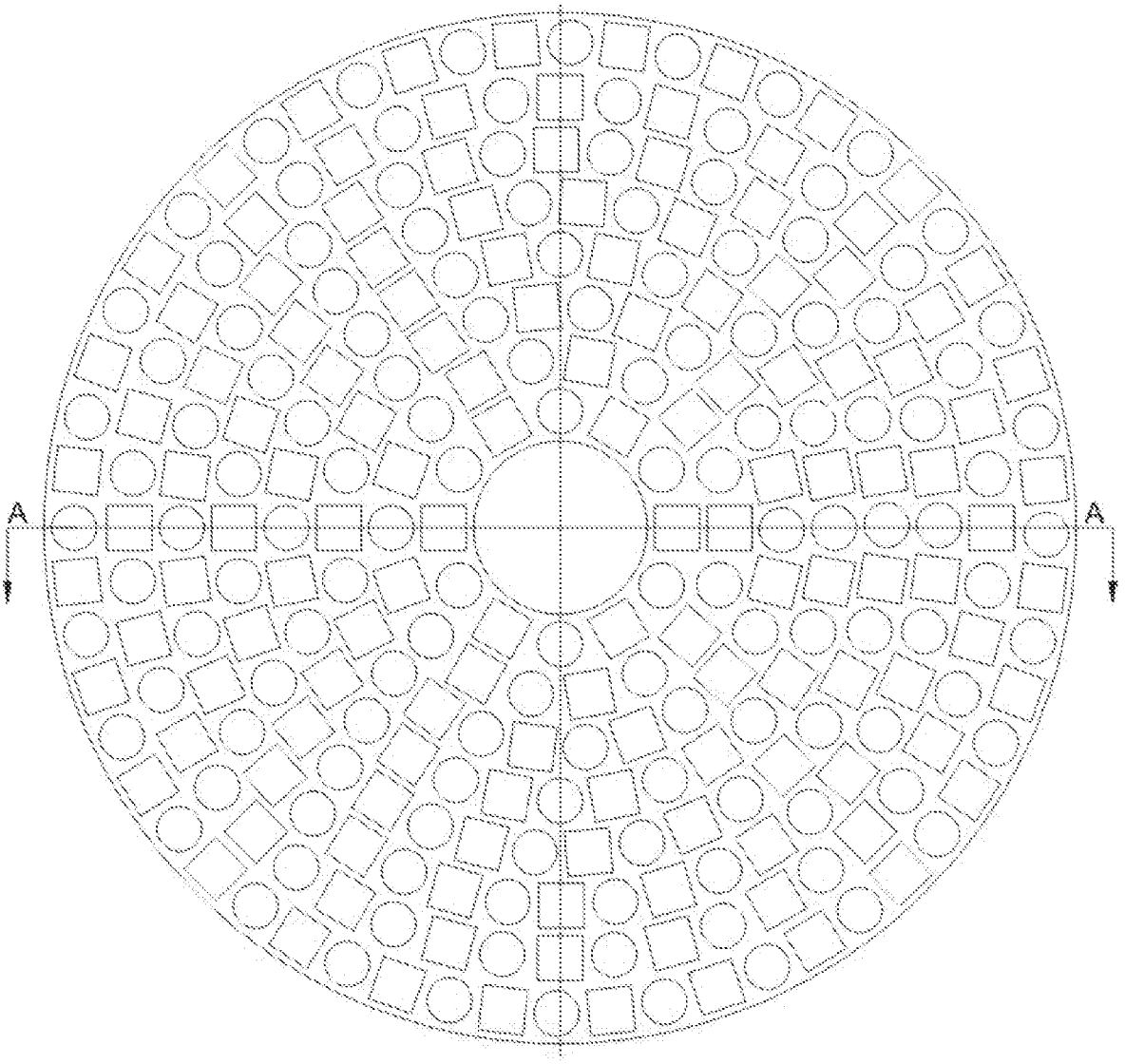
FIGS. 7*a* and 7*b* show a top view and a cross-section view, respectively, of a cylindrical lens made of the provided lightweight artificial dielectric material comprising a rod made of usual dielectric material and placed in the middle of the cylindrical lens.
Figure 7B:
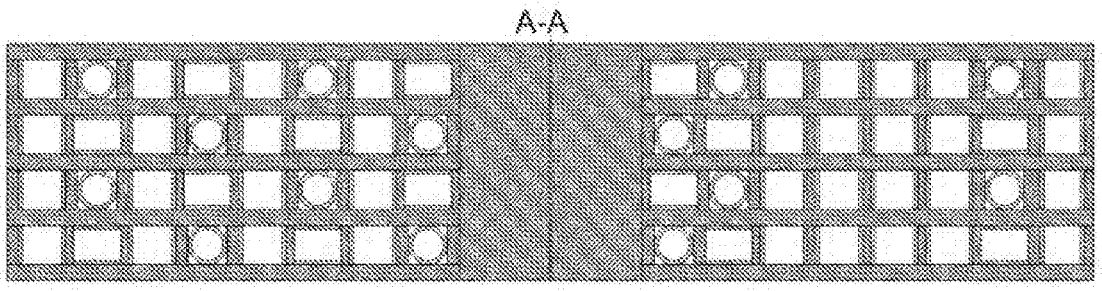

Another embodiment of the present invention is shown in in FIGS. 7*a* and 7*b* where a cylindrical lens made of the provided lightweight artificial dielectric material comprises a rod made of usual dielectric material and placed in the middle of the cylindrical lens. Such rod increases Dk in the middle of such cylindrical lens and provides mechanical support of lightweight dielectric sheets forming a lens. The rod could be cylindrical or could have a cross section in the shape of a polygon or a multi beam star. Layers of the cylindrical lens shown in FIGS. 7*a* and 7*b* have the same structure as the cylindrical lens shown in FIGS. 6*a* and 6*b*.

Figure 8A:
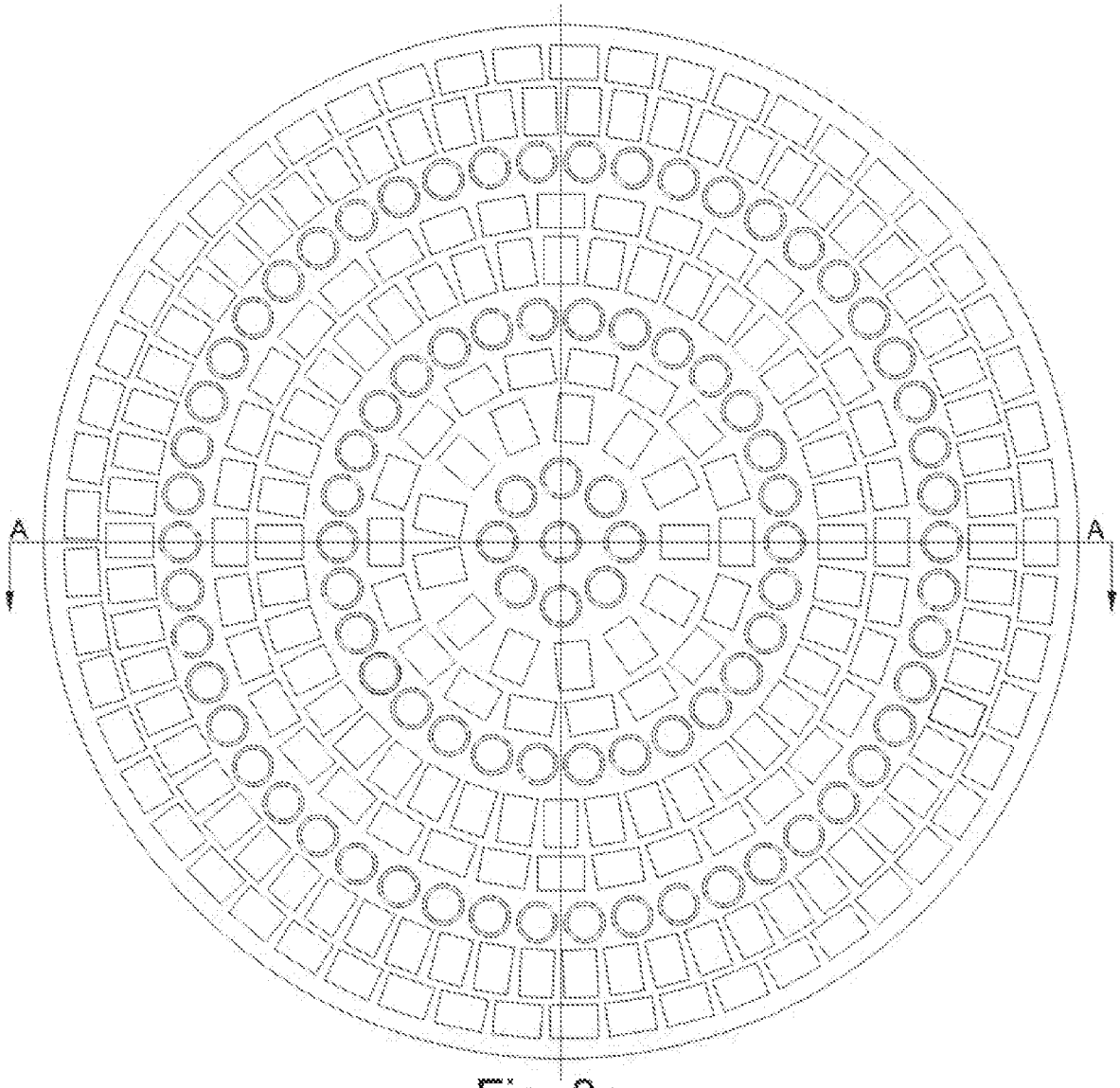
FIGS. 8*a* and 8*b* show a top view and a cross-section view, respectively, of a cylindrical lens comprising a plurality of short tubes placed in circles and having three orthogonal orientations of its axes.
Figure 8B:
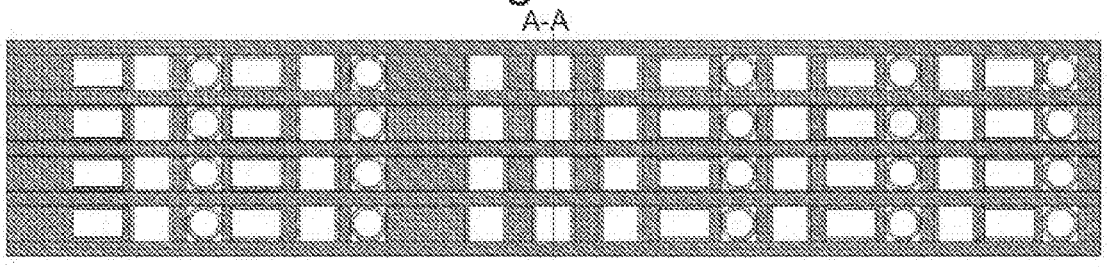

Another embodiment of the present invention is shown in in FIGS. 8*a* and 8*b* where each layer of a cylindrical lens comprises a plurality of short tubes placed in circles and having three orthogonal orientations of its axes. FIG. 8*a* shows the top view of a layer. Axes of tubes placed on the first circle from outer contour of a lens are directed in parallel to a layer and perpendicular to a circle. Axes of tubes placed on the second circle from outer contour of a lens are directed in parallel to a layer and perpendicular to a circle. Axes of tubes placed on the third circle from outer contour of a lens are directed perpendicular to a layer. Axes of tubes forming the first, fourth and seventh circles are directed in parallel to circles. Axes of tubes forming the second, fifth and eight circles are directed perpendicular to circles. Axes of tubes forming the third, sixth and ninth circles are directed perpendicular to a layer and these tubes are shorter than other tubes forming a layer. FIG. 8*b* shows the cross section of a cylindrical lens containing four equal layers shown in FIG. 8*a*. Thus such lens is assembled of layers of one kind only.

In one example, the diameter of the conductive tubes is about twenty times less than the wave length of the operating frequency to provide acceptable dependence of properties of the artificial dielectric material versus frequency. A length of the conductive tubes may be 0.2-5.0 of their respective diameter, dependent on desirable properties of the artificial dielectric material.

Density of the provided artificial dielectric material mainly depends on tubes' weight and density of the lightweight dielectric material. For example, polyethylene foam has density in the range 40-100 kg/m3. Aluminum tubes having diameter 6 mm and walls' thickness 0.1 mm have density 180 kg/m3. A provided artificial dielectric material containing such tubes and polyethylene foam has density approximately 140 kg/m3 and permittivity is approximately 2.5 when distances between the tubes and the layers are approximately 1 mm. Permeability of this material is approximately 0.75 and delay coefficient n is approximately 1.37.

A cylindrical lens was assembled of three kinds of foam polyethylene sheets containing hexagonal lattice of the tubes. The axes of the tubes disposed in the first sheet are directed in parallel to the longitudinal axis of the lens as shown in FIG. 2*a*. The axes of the tubes disposed in the second and the third sheets are directed in perpendicular to the longitudinal axis of the lens as shown in FIGS. 2*b* and 2*c*. The axes of the tubes disposed in the second and the third sheets are directed in perpendicular to each other. The sheets containing the tubes are separated by the foam polyethylene sheets without tubes as shown in FIG. 2*d*. The sheets were assembled inside of a fiberglass tube having diameter 350 mm and wall thickness 2 mm and pressed together between top and bottom covers disposed at edges of the fiberglass tube having length 400 mm. Such lens exited be one radiator emitting two slant polarization increases radiator's gain by 2.5 dB and provides cross polarization below 16 dB in 1.7-2.2 GHz frequency range. Such result demonstrates the properties of an example of such a provided artificial dielectric material.

A group of focusing lenses which could be created of the provided artificial dielectric material is not limited by the described above embodiments. Layers of focusing lenses could be formed by other structures also. For example by the structures shown in FIGS. 1*g* and 1*h* where axes of tubes forming each row are directed to three orthogonal directions. If tubes forming one layer of a cylindrical lens will be placed in circles each circle could contain tubes having three orthogonal directions of axes. Such lenses could be assembled of layers of one kind only. Tubes forming a layer could be equal or have different dimensions. Distances between tubes could be equal and form a structure providing permanent n along a layer. Distances between tubes could be not equal and form several areas providing different n along a layer. Such layers shown in FIGS. 5-7 of NZ patent application 752904 are formed by tubes having axes directed perpendicular to the layer. Because n depends on the angle between direction of electromagnetic wave crossing the material and axes of tubes such artificial dielectric material doesn't suit for many applications requiring isotropic dielectric material providing the same value of n for any direction and polarization of electromagnetic wave. The provided artificial dielectric material containing tubes having, for example, three orthogonal directions of axes is suitable for manufacturing spherical Luneburg lenses which have to be made of an isotropic dielectric material having the same n for any direction and polarization of electromagnetic wave.

In the claims which follow and in the preceding description of the invention, except where the context requires otherwise due to express language or necessary implication, the word "comprise" or variations such as "comprises" or "comprising" is used in an inclusive sense, i.e. to specify the presence of the stated feature but not to preclude the presence or addition of further features in various embodiments of the invention.

It is to be understood that, if any prior art publication is referred to herein, such reference does not constitute an admission that the publication forms a part of the common general knowledge in the art in any country.

The invention claimed is:

1. An artificial dielectric material comprising a plurality of sheets of a dielectric material and a plurality of short conductive tubes placed in the sheets of the dielectric material, wherein the sheets of the dielectric material containing the short conductive tubes are separated by sheets of the dielectric material without the short conductive tubes, and wherein axes of the tubes are orientated along at least two different directions.

2. The artificial dielectric material according to claim 1, wherein the at least two different directions are orthogonal directions.

3. The artificial dielectric material according to claim 1, wherein the short conductive tubes have a cross section in a shape of a circle or a polygon.

4. The artificial dielectric material according to claim 1, wherein the short conductive tubes are made of aluminum.

5. The artificial dielectric material according to claim 1, wherein the dielectric material is a foam polymer.

6. The artificial dielectric material according to claim 1, wherein the short conductive tubes placed in one layer form a square structure (lattice) providing equal distances between neighboring tubes disposed at the same row or at the same column or form a honeycomb structure (lattice) providing equal distances between any neighboring tubes.

7. The artificial dielectric material according to claim 1, wherein axes of the short conductive tubes placed in one layer are directed at the same direction.

8. The artificial dielectric material according to claim 7, wherein axes of the short conductive tubes placed in one layer are directed perpendicular to the layer.

9. The artificial dielectric material according to claim 7, wherein axes of the short conductive tubes placed in one layer are directed in parallel to the layer.

10. The artificial dielectric material according to claim 1, wherein axes of some short conductive tubes placed in one layer are directed perpendicular to the layer and axes of other short conductive tubes are directed in parallel to the layer.

11. The artificial dielectric material according to claim 10, wherein axes of the short conductive tubes directed in parallel to the layer are directed in different directions.

12. A cylindrical focusing lens comprising the artificial dielectric material according to claim 1.

13. The cylindrical focusing lens according to claim 12, wherein the tubes of each layer form a square or a hexagonal lattice.

14. The cylindrical focusing lens according to claim 12, wherein the tubes of each layer are placed radially in circles.

15. The cylindrical focusing lens according to claim 14, wherein each layer contains the tubes with axes directed perpendicular to the layer and the tubes with axes directed in parallel to the layer.

16. The cylindrical focusing lens according to claim 15, wherein axes of the tubes directed in parallel to the layer and displaced at even layers are directed in perpendicular to axes of the tubes directed in parallel to the layer and displaced at odd layers.

17. The cylindrical focusing lens according to claim 14, wherein each layer contains circles of the tubes having the axes directed perpendicular to the layer and circles of the tubes having the axes directed in parallel to the layer.

18. The cylindrical focusing lens according to claim 17, wherein at least one circle contains the tubes having the axes directed in parallel to the layer and in parallel to the circle.

19. The cylindrical focusing lens according to claim 17, wherein at least one circle contains the tubes having the axes directed in parallel to the layer and perpendicular to the circle.

20. The cylindrical focusing lens according to claim 12, comprising layers with tubes having axes directed only perpendicular to the layer and layers containing tubes having axes directed only in parallel to the layer.

21. The cylindrical focusing lens according to claim 20, wherein the axes of the tubes of the layer containing the tubes with axes directed only in parallel to the layer are directed in perpendicular to axes of the tubes of other layer containing the tubes with axes directed in parallel to the layer.

22. The cylindrical focusing lens according to claim 12, wherein a dielectric rod is placed along longitudinal axis of the cylindrical focusing lens.

23. A method for manufacturing an artificial dielectric material comprising placing short conductive tubes in a plurality of sheets of a dielectric material, and stacking said sheets together, wherein the sheets of the dielectric material containing the short conductive tubes are separated by sheets of the dielectric material without the short conductive tubes, and wherein axes of the tubes are orientated along at least two different directions.

24. The method according to claim 23, wherein the short conductive tubes are placed into pre-existing holes in the sheets of the dielectric material.

* * * * *